US006486623B2

(12) United States Patent
Van Vroonhoven

(10) Patent No.: US 6,486,623 B2
(45) Date of Patent: Nov. 26, 2002

(54) COLOR DISPLAY DEVICE WITH FIRST AND SECOND DYNAMIC FOCUSING VOLTAGES

(75) Inventor: Jozef Cornelis Walterus Van Vroonhoven, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/747,113

(22) Filed: Dec. 21, 2000

(65) Prior Publication Data

US 2001/0015627 A1 Aug. 23, 2001

(30) Foreign Application Priority Data

Dec. 24, 1999 (EP) ..... 99204528

(51) Int. Cl.[7] ..... H01J 29/48

(52) U.S. Cl. ..... 315/382; 313/414; 315/15

(58) Field of Search ..... 315/382, 382.1, 315/14, 15, 16, 17; 313/412, 413, 414, 428

(56) References Cited

U.S. PATENT DOCUMENTS

| | | | | |
|---|---|---|---|---|
| 4,814,670 A | | 3/1989 | Suzuki et al. | 315/15 |
| 5,831,399 A | | 11/1998 | Ohta et al. | 315/382.1 |
| 6,144,150 A | * | 11/2000 | Ueda et al. | 313/414 |

* cited by examiner

*Primary Examiner*—David Vu

(57) ABSTRACT

A color display device with an improved focus performance. Conventional color display tubes with DAF have an electron gun with a second focusing electrode (25) driven with a dynamic voltage which is varied synchronously with the deflection field. The dynamic quadruple lens formed between the first focusing electrode (23) and the second focusing electrode (25) is designed such that the horizontal lens action, which arises when the voltage on the second focusing electrode is increased, should be compensated by the main lens which becomes weaker when the voltage on the second focusing electrode is increased. In practice, this is not possible in the required range of the dynamic voltage on the second focusing electrode, leading to a deterioration of the focus performance of the color display device. This problem is solved by applying a dynamic voltage to the first focusing electrode so that it is possible to focus the electron spots on the display window (3) in the horizontal and vertical directions, resulting in an optimally focused picture.

20 Claims, 5 Drawing Sheets

COLOR DISPLAY DEVICE WITH FIRST AND SECOND DYNAMIC FOCUSING VOLTAGES

BACKGROUND OF THE INVENTION

This invention relates to a color display device provided with a color display tube having an electron gun, a display window opposite the electron gun, and a deflection unit positioned on the outer side of the color display tube between the electron gun and the display window. The electron gun comprises a first focusing electrode, a second focusing electrode and a final electrode, as viewed in the direction from the electron gun to the display window, to which electrodes voltages are applied during operation. The voltage applied to the second focusing electrode is a dynamic voltage, the first focusing electrode and the second focusing electrode forming a quadruple lens system. The electron gun generates, during operation, electron beams which are deflected by a line and a frame deflection field generated by the deflection unit to scan the entire display window.

A color display device as described in the opening paragraph is disclosed in U.S. Pat. No. 4,814,670. The electron gun according to this patent is provided with two focusing electrodes. During operation the first focusing electrode is driven by a constant voltage, while the second focusing electrode is driven by a dynamic voltage.

The geometry of opposing apertures in the first and the second focusing electrode forms a quadrupole lens. The dynamically varying voltage on this electrode causes the quadrupole lens to change dynamically. Furthermore, the main lens formed by the second focusing electrode and the final electrode also varies in a dynamic way. An electron gun of this type counteracts the astigmatism caused by the deflection field and reduces the vertical spot size on the periphery of the screen.

This type of electron gun is known as DAF (Dynamic Astigmatism and Focus) gun, indicating that the dynamic voltage on the second focusing electrode varies both the quadrupole lens—dynamic astigmatism—and the main lens—dynamic focus—of the electron gun.

In practice, however, the colour display device disclosed in U.S. Pat. No. 4,814,670 has some limitations. Especially in colour display tubes with a real-flat screen or with a large deflection angle, it appears that the amount of astigmatism that originates from the deflection unit and has to be counteracted by the electron gun is rather large. This leads to a deterioration of the focus performance of the color display device.

SUMMARY OF THE INVENTION

It is in the object of the invention to provide a color display device of the kind described in the opening paragraph, which has a significant improvement of focus performance by overcoming the limitations of the color display device disclosed in U.S. Pat. No. 4,814,670.

According to the present invention, this object is realized with a colour display device, which is improved as compared with the device described in the opening paragraph, and is characterized in that the voltage applied to the first focusing electrode is a dynamic voltage.

The invention is based on the recognition that, for a well-focused picture all over the screen, the dynamic varying quadrupole lens and the dynamic varying main lens have to compensate each other in the direction of the line deflection through the range in which the voltage on the second focusing electrode is changed. This compensation is required because a self-converging deflection field is applied in most colour display tubes. This means that the three electron beams are converged on the entire display window due to the action of the deflection unit. Consequently, in the direction of the line deflection, the electron beams are focused on the entire display window. A change in the dynamic voltage on the second focusing electrode may not lead to a defocusing effect.

Due to the different lens characteristics of a quadrupole lens and a main lens, it is not possible to have a good compensation of the lens action in the direction of the line deflection between the quadrupole lens and the main lens if the dynamic voltage which is required for vertically focusing the electron beam on the screen becomes too large. This is especially the case when the colour display tube is provided with a real-flat screen or when the deflection angle is increased. Both these examples lead to a higher astigmatic component in the deflection unit, which has to be counteracted by the DAF gun.

In a prior art DAF gun, two lenses—the quadrupole lens and the main lens—are varied dynamically by using only one dynamic voltage, namely on the second focusing electrode. In practice, these two lenses do not exactly compensate each other in the direction of the line deflection. The difference in lens action between the quadrupole lens and the main lens that remains when the voltage on the second focusing electrode is varied can be compensated for by also dynamically varying the voltage on the first focusing electrode.

In a preferred embodiment, the dynamic voltage applied to the first focusing electrode varies synchronously with the line deflection field.

In a DAF gun, the dynamically varying quadrupole and main lens counteract the astigmatism that the deflection field introduces and which astigmatism leads to a worse focus performance, that is, a larger spot size on the display window. Due to the self-converging character of the deflection field, the effect on the focus performance is largest in the direction of the line deflection. In first order, the line deflection is a linear function of the line deflection field, which is driven by a sawtooth-shaped voltage. As a consequence, the largest gain in focus performance is achieved if the dynamic voltage is varied as a function of the line deflection field.

In a further preferred embodiment, the dynamic voltage applied to the first focusing electrode varies synchronously with the frame deflection field.

Although the effect of the astigmatism introduced by the self-converging deflection field much smaller is in the frame direction than in the line direction, the focus performance is further improved by adding a component to the dynamic voltage which is varied as a function of the frame deflection.

If the dynamic voltage varies with both the line and the frame deflection, the dynamic voltage is the sum of a component which varies synchronously with the line deflection field and of a component that varies synchronously with the frame deflection field. This is what is understood to be synchronous in both the line and the frame direction.

In another embodiment, the dynamic voltage applied to the first focusing electrode varies substantially parabolically as a function of the line deflection field. When no dynamic voltage is applied, the spots on the display window show a large dimension in the frame direction. In principle, in a colour display tube with a self-converging deflection field, the spot is in focus in the line direction. It appears that the dimension of the spot in the frame direction can be strongly reduced by applying a parabolically shaped focusing voltage. Another advantage of a parabolically shaped focusing voltage is that such a shape is easy to realize. The deflection field is mostly driven with a sawtooth-shaped voltage, that is a linear function of the deflection, and a parabolic voltage can be derived from this by simply integrating the deflection voltage. This argument holds for the line and the frame direction.

In a further embodiment, the dynamic voltage applied to the first focusing electrode varies substantially parabolically as a function of the frame deflection field.

This gives a further improvement of the focus performance because the spot size in the frame direction is now also reduced when the electron beam is deflected in the frame direction.

In another embodiment, the dynamic voltage applied to the first focusing electrode has a value which comprises a fourth-order term as a function of the line deflection field.

A fourth-order term ensures that the correction for the areas close to the edge of the screen better fits the amount prescribed by the astigmatism of the deflection unit. This leads to a focus performance which is even better as compared with the situation where only parabolic corrections are used.

BRIEF DESCRIPTION OF THE DRAWING

These and other aspects of the color display device according to the present invention will be apparent from and will be elucidated by way of non-limitative examples with reference to the drawings and the embodiments described hereinafter.

In the drawings.

DESCRIPTION OF THE PREFERRED EMBODIMENTS

Figure 1:
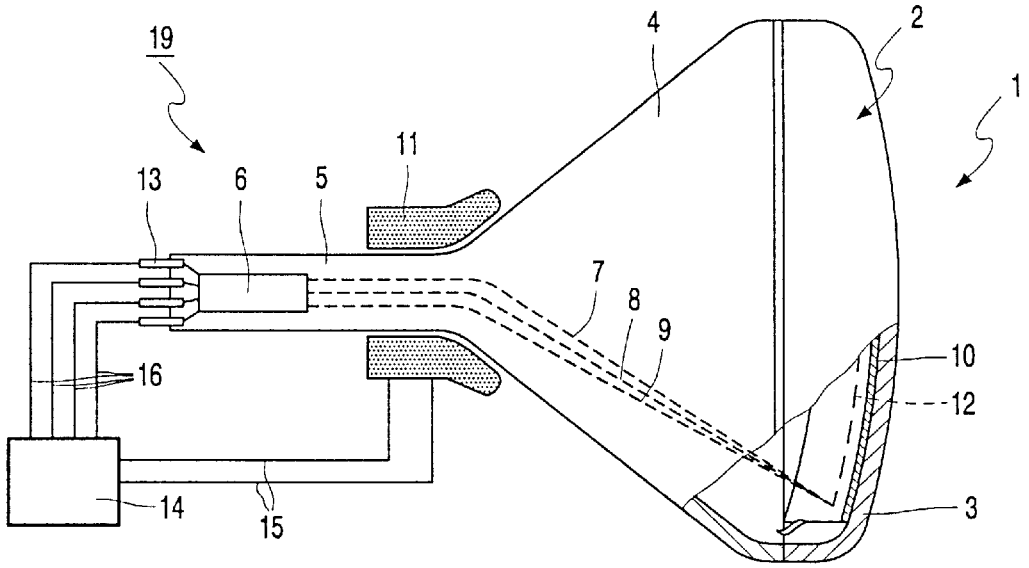
FIG. 1 is a sectional view of the color display device.

The colour display tube 1 shown in FIG. 1 comprises an evacuated glass envelope 2 with a display window 3, a funnel-shaped part 4 and neck portion 5. A screen 10 having a pattern of, for example, lines or dots of phosphors luminescing in different colours—e.g. red, green, and blue—may be arranged on the inner side of the display window 3. A colour selection electrode 12 is spaced apart from the screen 10. During operation of the colour display tube, an electron gun 6 arranged in the neck portion 5, and couple via pins 13 to external power supplies 14, sends electron beams 7, 8, 9 through the colour selection electrode 12 to the screen 10 so that the phosphers will emit light. The electron beams 7, 8, 9 have a mutual angle so that, at the proper mask-to-screen distance, the electron beams only impinge on the phosphers of the associated colour.

A deflection unit 11 ensures that the electron beams systematically scan the screen 10. In general, a deflection unit 11 comprises means for deflecting the electrons in the horizontal direction and in the vertical direction. To achieve this, the deflection unit 11 generates a horizontal and a vertical deflection field, which are commonly called the line and frame field, the line direction being in the plane of the electron beams 7, 8, 9. The electron beams scan horizontal lines starting at the top and ending at the bottom of the screen.

Besides the colour display tube 1, the colour display device 19 comprises electronic circuitry 14 for driving the colour display tube 1. This electronic circuitry 14 is connected by leads 16 to pins 13 of the colour display tube 1. It is further connected by leads 15 to the deflection unit 11. The electronic circuitry 14 generates, amongst others, the voltages required for driving the electron gun, including the dynamic voltages that are applied to the first focusing electrode 23 and the second focusing electrode 25. As these voltages are preferably varied synchronously with the deflection field, the value of this deflection field serves as input for generating the dynamic voltages. The electronic circuitry 14 further comprises the video amplifiers for driving the cathodes in order to create a picture on the display window 3.

Figure 2:
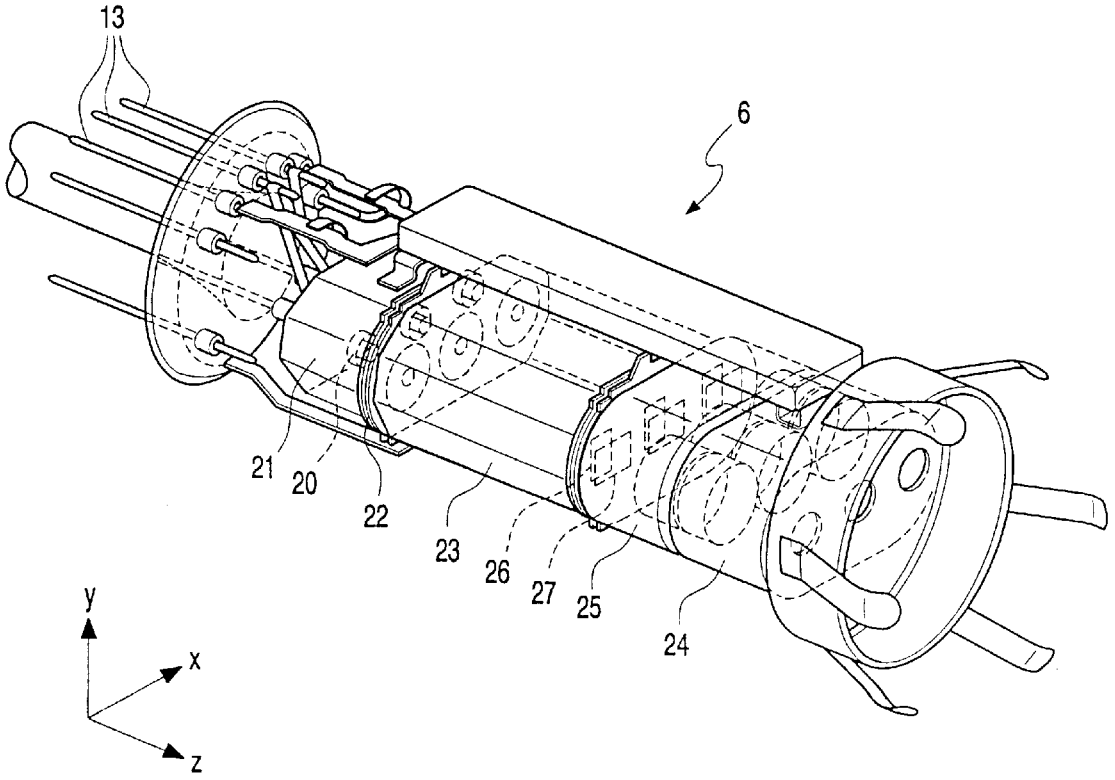
FIG. 2 is a perspective and transparent view of an electron gun for use in the color display device.

FIG. 2 shows, by way of example, the electron gun 6 in a schematical and semi-transparent drawing. The electron gun 6 comprises a beam-generating region, mostly called the triode. This triode consists of three in-line electron sources 20, e.g. cathodes, a first electrode 21 and a second electrode 22. In most current electron guns, the first electrode 21 is called grid 1 (G1) and is connected to ground; the second electrode 22 (G2) is mostly connected to a potential in the range of 500–1000 V. The gun also comprises a beam-shaping or prefocusing section. In this example, the prefocusing section has a prefocusing lens formed by the electrodes 22 and 23, in which electrode 23 is the first focusing electrode, normally provided with an operating potential between 5 kV and 9 kV. The prefocusing section may also comprise additional electrodes; more complex lens systems are possible for the prefocusing section, so this example should not be considered as limitative.

In a DAF gun, as given in this example, the main focusing section is formed by the combination of the quadrupole lens and the main lens. This section creates a focused image of the virtual object as generated by the triode section. The quadrupole lens is positioned between the first focusing electrode 23 and the second focusing electrode 25, the latter having an operating potential between 5 kV and about 10 kV, while the main lens is positioned between the second focusing electrode 25 and the final electrode 24, also referred to as the anode. A typical operating potential for the final electrode is in the range of 25–35 kV.

Figure 3:
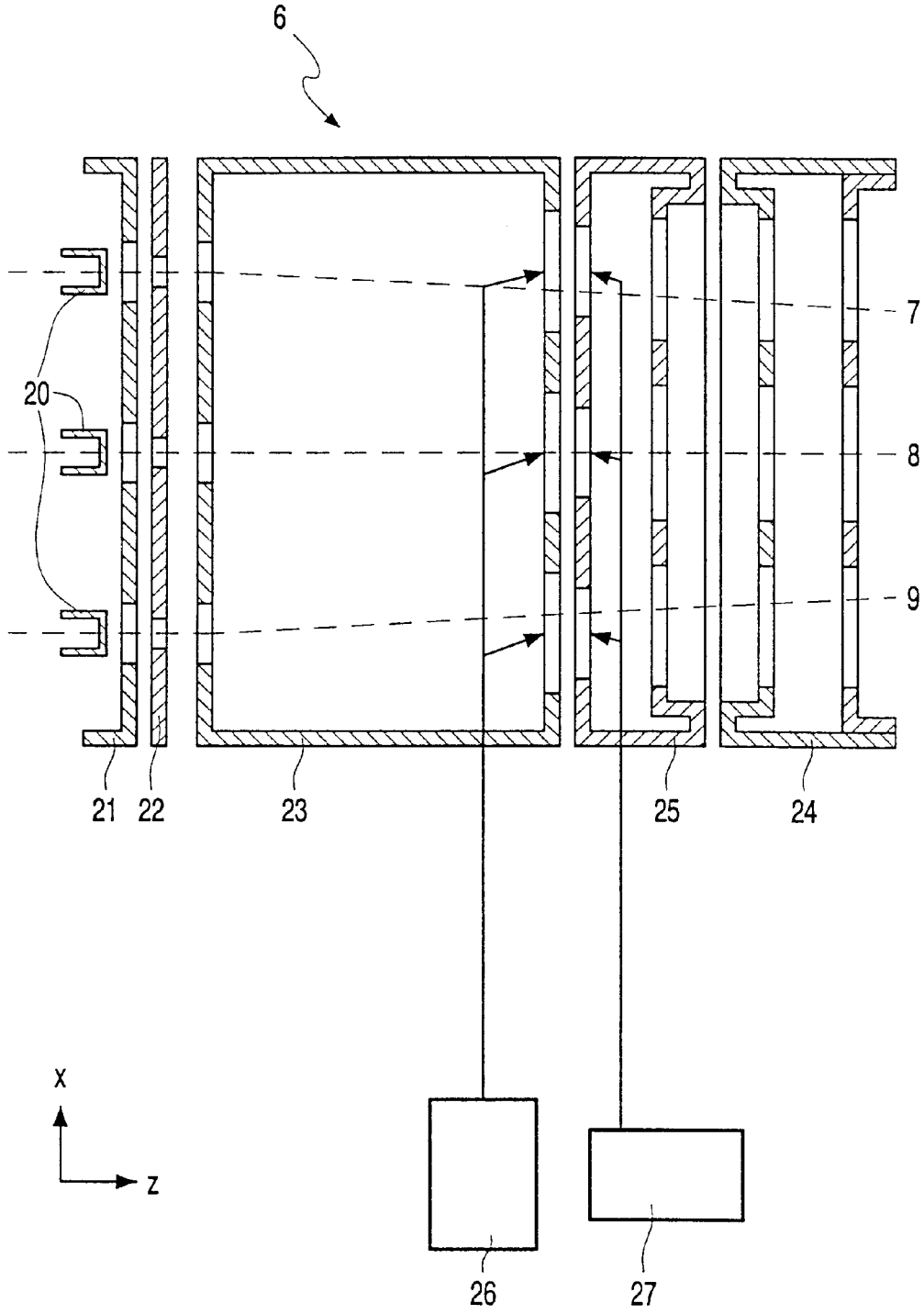
FIG. 3 is a schematic cross-section of the electron gun through the plane of the electron beams.

FIG. 3 is a cross-section of the electron gun 6, viewed in the plane of the electron beams 7, 8, 9. In this Figure the rectangular apertures 26 and 27 of the quadrupole lens are clearly indicated.

Figure 4:
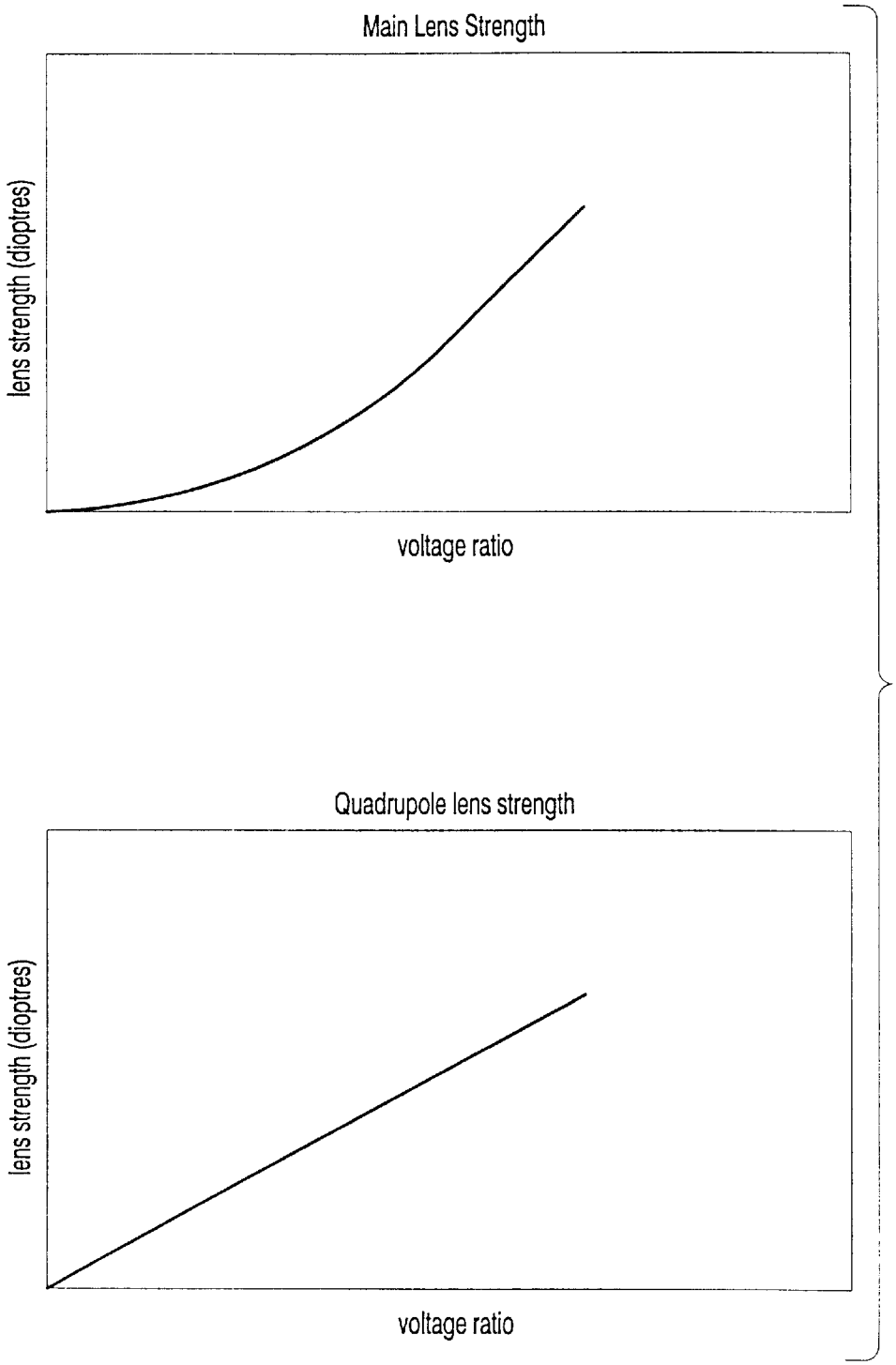
FIG. 4 gives the lens power of a main lens and of a quadrupole as a function of the voltage ratio.

In FIG. 4, the lens power, in dioptres, of the main lens and the quadrupole lens is given as a function of the voltage ratio. The voltage ratio is understood to mean the ratio of the voltages constituded by the corresponding lens; for the quadrupole lens it is the ratio between the voltage on the second focusing electrode 25 and the first focusing electrode 23, while for the main lens it is the ratio of the voltage on the final electrode 24 and the second focusing electrode 25. In theory, the power of a quadrupole lens, measured in dioptres, is directly proportional to the activation of the lens, measured in terms of the voltage ratio between the two electrodes forming the quadrupole lens. For a main lens, which is basically a rotationally symmetric lens, the lens power is quadratic with the activation of the lens.

In a DAF gun, an increase of the dynamic voltage on the second focusing electrode leads, in the horizontal direction, to an increased power of the quadrupole lens and a decreased power of the main lens. The geometry of the quadrupole lens, i.e. the dimensions of the apertures 26 and 27 has to fit with the design of the main lens, in order to make sure that these two effects cancel each other. In the vertical direction, an increase of the dynamic voltage on the second focusing electrode leads to a decreased lens power for both the quadrupole and the main lens, resulting in the desired diverging lens action on the vertical beam. The design of the quadrupole lens should have these properties because the use of a self-converging deflection field leads to a spot on the display window 3 which is, in principle, horizontally in focus and vertically overfocused. The word overfocused means that the lens is too strong, leading to an electron spot with haze. For instance, In FIG. 5A the haze is indicated by 44, 45, 46.

The quadrupole lens should be designed in such a way that the proportionality between lens power and voltage ratio substantially equals the tangent in the quadratic relationship between lens power and voltage ratio of the main lens in the operating range.

If the quadrupole lens is activated by increasing the voltage on the second focusing electrode, the main lens is weakened. Consequently, the tangent in FIG. 4 of the main lens power is diminished when the main lens is made weaker. The combination of quadrupole and main lens is no longer fully compensating in the horizontal direction, and a converging effect remains. This leads to a non-focused spot in the horizontal direction. Now, the spot can be horizontally refocused by varying the voltage on the first focusing electrode 23.

This means that the focus performance can be improved by also providing a dynamic voltage to the first focusing electrode.

Figure 5A:
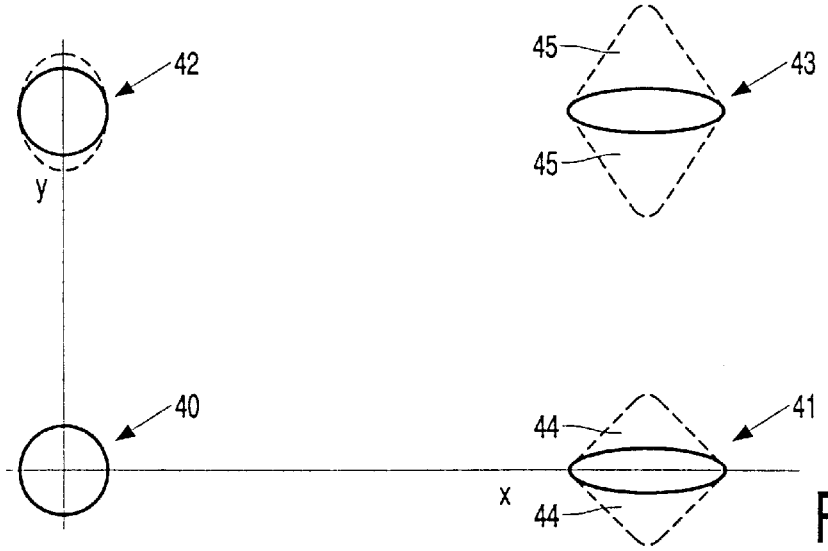
FIGS. 5*a*–5*c* show the spot shape at different positions on the display window for colour display tubes driven without a dynamic focusing voltage, with one and with two dynamic focusing voltages, respectively.
Figure 5B:
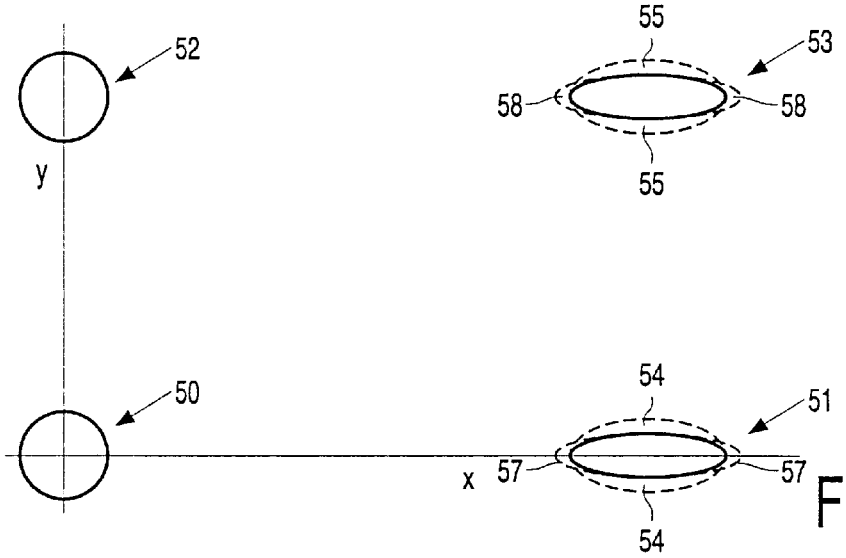
Figure 5C:
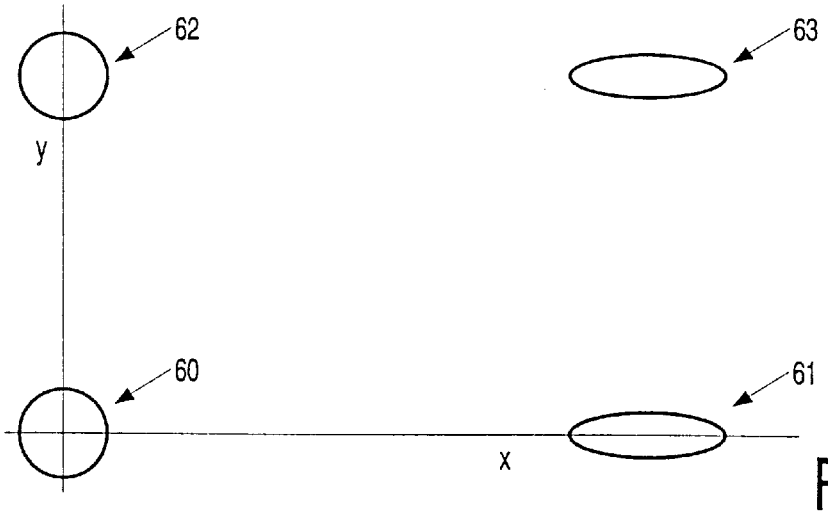

The effects on the spot size, and thus on the focus performance, are given in FIGS. 5A–5C. In these Figures, the spot sizes on the display window are given for four positions, namely Centre 40, 50, 60, East (end of the horizontal axis) 41, 51, 61, North (end of the vertical axis) 42, 52, 62 and North-East (corner) 43, 53, 63. FIG. 5A relates to an electron gun without any dynamic voltage. This gives the spot sizes that result from the self-converging deflection field: horizontally in focus, but vertically showing much haze 44, 45, 46. By applying a conventional DAF gun, that is, with only a dynamic voltage on the second focusing electrode, the situation of FIG. 5B can be obtained. Practically all the vertical haze 54, 55 disappears, but at the expense of some horizontal haze 57, 58, due to the above-mentioned effect that main lens and quadrupole lens are no longer fully compensating. The amount of dynamic voltage is chosen to obtain a good compromise between the horizontal and the vertical spot size, which a further increase of the dynamic voltage on the second focusing electrode 25 will reduce the vertical haze at the expense of a larger horizontal spot size.

FIG. 5C gives the optimal situation. By also having a dynamic voltage for driving the first focusing electrode 23, the dynamic voltage on the second focusing electrode 25 can be increased just as far as is necessary to remove all vertical haze, which the dynamic voltage on the first focusing electrode 23 ensures that the spot remains horizontally in focus.

Figure 6:
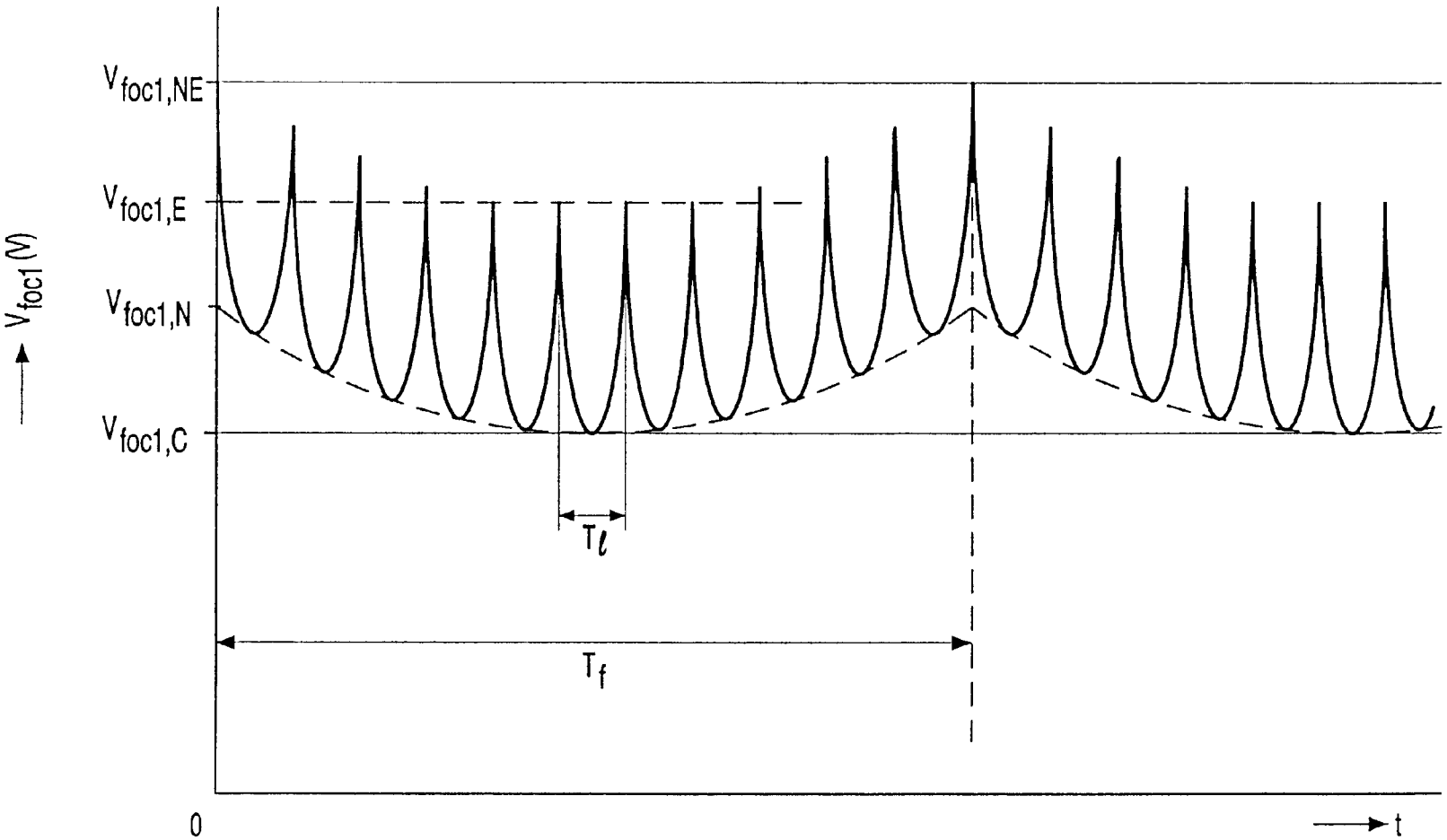
FIG. 6 is a diagram of an example of the dynamic voltage on the first focusing electrode.

The dynamic voltage on the first focusing electrode 23 is generated by the electronic circuitry 14, using the deflection field as input. For example, this dynamic voltage may be a parabolic function of the line and frame deflection field, as is illustrated in FIG. 6. The indications $T_1$ and $T_f$ in this Figure refer to the line and frame period, respectively. This is the period which is necessary to write one line or one frame on the display window 3.

Both the line and the frame deflection are more or less sawtooth-shaped. This means that the current in the deflection unit is proportional to the deflection obtained. From the deflection current, which is linear with the deflection, it is relatively simple to obtain a dynamic voltage which is parabolic, i.e. quadratic, with the deflection. This can be achieved by supplying the electronic circuitry with an integrator.

In this way, the first focusing electrode 23 can be driven with a dynamic voltage, $V_{foc1}$ of the following form:

$$V_{foc1}=A+B.x^2+C.y^2+D.x^2.y^2$$

in which x and y are the relative horizontal and vertical position on the display window 3, which means that x,y $\epsilon[-1,1]$.

A dynamic voltage of this shape is parabolic in both the x (horizontal) and the y (vertical) direction. The four coefficients make it possible to adjust the dynamic voltage for four independent positions—Centre, North, East and North-East—on the display window.

Especially the last term gives the opportunity to adjust the focus in North-East separately from the points in East and North. The coefficients can be rewritten in the form of:

$$A=V_{foc1,C}$$

$$B=V_{foc1,E}-V_{foc1,C}$$

$$C=V_{foc1k,N}-V_{foc1,C}$$

$$D=V_{foc1,NE}-V_{foc1,N}-V_{foc1,E}+V_{foc1,C}$$

in which $V_{foc1,C}$, $V_{foc1,E}$, $V_{foc1,N}$ and $V_{foc1,NE}$ stands for the value of the voltage on the first focusing electrode 23 in the Centre, East, North and North-East, respectively.

If a similar function is chosen for the dynamic voltage on the second focusing electrode 25 is chosen, it is to be noted that the value of the coefficients A, B, C, and D is general by different for the dynamic voltage on the first focusing electrode and the dynamic voltage on the second focusing electrode, because otherwise the quadrupole lens would be practically constant instead of dynamically varying on the display window.

Evidently, more complex functions for the dynamic voltages are also possible, such as, for instance, by adding a term which is proportional to the fourth power of the deflection. It is also possible to correct some errors originating from, for instance, asymmetries in the electron gun 6 or in the deflection unit 11 by making the dynamic voltage asymmetric. An example of such an asymmetric function is a parabola which has different values in the East and West positions of the display window 3.

In summary, a colour display device 19 is disclosed with an improved focus performance. In present-day colour display tubes with DAF, the electron gun is provided with a second focusing electrode 25 driven with a dynamic voltage which is varied synchronously with the deflection field. The dynamic quadrupole lens formed between the first focusing electrode 23 and the second focusing electrode 25 is designed in such a way that the horizontal lens action, which arises when the voltage on the second focusing electrode is increased, should be compensated by the main lens which becomes weaker when the voltage on the second focusing electrode 25 is increased. In practice, it is not possible to achieve this in the required range of the dynamic voltage on the second focusing electrode 25, leading to a deterioration of the focus performance of the colour display device 19. This problem is solved by the present invention. By applying a dynamic voltage to the first focusing electrode 23, it becomes possible to focus the electron spots on the display window 3 in the horizontal and vertical directions, resulting in an optimally focused picture.

What is claimed is:

1. A colour display device comprising: a color display tube having an electron gun, a display window opposite the electron gun, and a deflection unit positioned on the outer side of the colour display tube between the electron gun and the display window, which electron gun comprises a first focusing electrode, a second focusing electrode and a final focusing, as viewed in the direction from the electron gun to the display window, means for applying a dynamic voltage to the second focusing electrode, the first focusing electrode and the second focusing electrode forming a quadrupole lens system, said electron gun generating, during operation, electron beams which are deflected by a line and a frame deflection field generated by the deflection unit to scan the entire display window, and a means for applying a dynamic voltage to the first focusing electrode.

2. A color display device as claimed in claim 1, wherein the dynamic voltage applied to the first focusing electrode varies synchronously with the line deflection field.

3. A color display device as claimed in claim 1, wherein the dynamic voltage applied to the first focusing electrode varies synchronously with the frame deflection field.

4. A color display device as claimed in claim 2, wherein the dynamic voltage applied to the first focusing electrode varies substantially parabolically as a function of the line deflection field.

5. A color display device as claimed in claim 3, wherein the dynamic voltage applied to the first focusing electrode varies substantially parabolically as a function of the frame deflection field.

6. A color display device as claimed in claim 2, wherein the dynamic voltage applied to the first focusing electrode has a value which comprises a fourth-order term as a function of the line deflection field.

7. A color display device as claimed in claim 1 wherein the first and second focusing electrodes are electrically separated from one another.

8. A color display device as claimed in claim 1 wherein the first and second electrodes are positioned adjacent one another in the direction of the electron beams.

9. A color display device as claimed in claim 1 wherein in the dynamic voltage applied to the first focusing electrode is independent of the dynamic voltage applied to the second focusing electrode.

10. A color display device as claimed in claim 8 wherein the second focusing electrode and the final electrode are positioned adjacent one another in the direction of the electron beams.

11. A color display device as claimed in claim 1 wherein the fist dynamic voltage is applied to the first focusing electrode and a second dynamic voltage is applied to the second focusing electrode such that a dynamic varying quadrupole lens and a dynamic varying main lens formed by the second focusing electrode and the final electrode substantially compensate each other, at least in the direction of the line deflection.

12. A color display device as claimed in claim 1 wherein the dynamic voltage applied to at least one of the first and second focusing electrodes is synchronized with the deflection of the electron beams.

13. A color display device as claimed in claim 1 wherein the dynamic voltage applied to the first focusing electrode varies in a substantially parabolic manner as a function of both the line deflection field and the frame deflection field.

14. An electron gun for use in an electron beam color display tube having a deflection unit, comprising:

an electron beam triode generating means, first and second electrodes aligned along the longitudinal axis of the electron gun, first and second focus electrodes adjacent one another and aligned along the longitudinal axis of the electron gun, a final electrode aligned along the longitudinal axis of the electron gun with the first and second focus electrodes, wherein the first and second focus electrodes form a quadrupole lens system and the second focus electrode and the final electrode form a main lens, and a first dynamic voltage is applied to the first focus electrode and a second dynamic voltage is applied to the second focus electrode.

15. The electron gun as claimed in claim 14 wherein the first and second focusing electrodes are electrically separated from one another.

16. The electron gun as claimed in claim 14 wherein, during operation, the dynamic voltage applied to at least one of the first and second focusing electrodes is synchronized with the deflection of the electron beams by the deflection unit of the color display tube.

17. The electron gun as claimed in claim 14 wherein the first and second dynamic voltages are applied independently to the first and second focus electrodes, respectively.

18. A method of displaying video information on the screen of a color display tube having an electron gun and a deflection unit, comprising:

generating an electron beam by means of said electron gun, accelerating the electron beam towards the screen of the color display tube, deflecting the electron beam in a horizontal and a vertical direction, applying a first dynamic focus voltage to a first focus electrode of the electron gun, and applying a second different dynamic focus voltage to a second focus electrode of the electron gun.

19. The display method as claimed in claim 18 wherein the first and second dynamic focus voltages are independent of one another.

20. The display method as claimed in claim 18 which further comprises;

adjusting the first and second dynamic focus voltages such that an electron spot produced on the screen by the electron beam is in focus substantially over the entire surface of the screen.

* * * * *